US005996517A

United States Patent [19]

Tomita

[11] Patent Number: 5,996,517

[45] Date of Patent: Dec. 7, 1999

[54] SEWING APPARATUS HAVING COLOR DISPLAY CONTROLLING DEVICE

[75] Inventor: Shintaro Tomita, Nagoya, Japan

[73] Assignee: Brother Kogyo Kabushiki Kaisha, Nagoya, Japan

[21] Appl. No.: 09/163,352

[22] Filed: Sep. 30, 1998

[30] Foreign Application Priority Data

Sep. 30, 1997 [JP] Japan ..... 9-267425
Sep. 30, 1997 [JP] Japan ..... 9-284699

[51] Int. Cl.[6] ..... D05B 21/00; D05C 5/02

[52] U.S. Cl. ..... 112/102.5; 112/445

[58] Field of Search ..... 112/470.01, 453, 112/454, 445, 456, 458, 102.5, 470.06; 364/470.09

[56] References Cited

U.S. PATENT DOCUMENTS 4,416,208 11/1983 Nufer .
4,602,583 7/1986 Hanyu ..... 112/458
4,869,188 9/1989 Hyodo ..... 112/445
5,253,599 10/1993 Hashiride ..... 112/445 X
5,775,241 7/1998 Morita .
5,794,552 8/1998 Owaki ..... 112/445 X

FOREIGN PATENT DOCUMENTS 56-91574 7/1981 Japan .
57-55179 4/1982 Japan .
59-20194 2/1984 Japan .
9-192363 7/1997 Japan .

*Primary Examiner*—Peter Nerbun
*Attorney, Agent, or Firm*—Oliff & Berridge, PLC

[57] ABSTRACT

A sewing apparatus is provided with: a stitch forming device; a driving device for driving the stitch forming device; a controller for controlling the driving device; a displaying device including a plurality of display segments, each of which indicates information to control a sewing process through the controller, on a surface of the displaying device, the display segments being divided into a plurality of segment groups, each of which includes at least one of display segment, on the basis of a predetermined criterion; and a display controlling device for controlling the displaying device to display thereon all of the at least one segment belonging to one of the segment groups and all of the at least one segment belonging to another of the segment groups so as to be visually differentiated from each other.

21 Claims, 14 Drawing Sheets

FIG. 5A

| ADDRESS 50 | | |
|---|---|---|
| 0 | LEAD ADDRESS OF FOOT N | 50a |
| | LEAD ADDRESS OF FOOT J | 50b |
| | LEAD ADDRESS OF FOOT A | 50c |
| | LEAD ADDRESS OF FOOT R | 50d |
| | LEAD ADDRESS OF FOOT Q | 50e |
| | LEAD ADDRESS OF FOOT M | 50f |
| | LEAD ADDRESS OF BACKSTITCH KEY | 50g |
| | LEAD ADDRESS OF THREAD CUTTING KEY | 50h |
| | LEAD ADDRESS OF ADVICE KEY | 50i |
| | LEAD ADDRESS OF HOW TO SEW KEY | 50j |
| | LEAD ADDRESS OF DECREASE KEY | 50k |
| | LEAD ADDRESS OF INCREASE KEY | 50l |
| | LEAD ADDRESS OF REDUCTION KEY | 50m |
| | LEAD ADDRESS OF EXTENSION KEY | 50n |
| | LEAD ADDRESS OF LOW KEY | 50o |
| | LEAD ADDRESS OF AUTO KEY | 50p |
| | LEAD ADDRESS OF HIGH KEY | 50q |
| | LEAD ADDRESS OF PREVIOUS PAGE KEY | 50r |
| | LEAD ADDRESS OF NEXT PAGE KEY | 50s |
| | LEAD ADDRESS OF PATTERN ① | 50t |
| | LEAD ADDRESS OF PATTERN ② | 50u |
| | LEAD ADDRESS OF PATTERN ③ | 50v |
| | • | |
| | • | |
| | • | |
| | • | |
| | • | |

FIG. 5B

| ADDRESS 60 | | |
|---|---|---|
| 10000 | COLOR CODE OF FOOT N | 60a |
| 10001 | BMP DATA OF FOOT N | 60b |
| 10100 | COLOR CODE OF FOOT J | 60c |
| | BMP DATA OF FOOT J | 60d |
| | • | |
| | • | |
| | • | |
| | • | |
| 12000 | COLOR CODE OF BACKSTITCH KEY | 60e |
| 12001 | BMP DATA OF BACKSTITCH KEY | 60f |
| 14000 | COLOR CODE OF PATTERN ① | 60g |
| 14001 | BMP DATA OF PATTERN ① | 60h |
| 14200 | COLOR CODE OF PATTERN ② | 60i |
| 14201 | BMP DATA OF PATTERN ② | 60j |
| | • | |
| | • | |
| | • | |

SEWING APPARATUS HAVING COLOR DISPLAY CONTROLLING DEVICE

BACKGROUND OF THE INVENTION

1. Field of the Invention

The present invention relates to a sewing apparatus including a sewing machine, which is provided with a CPU (Central Processing Unit) and which can electronically perform information processing, such as a selection of a pattern to be sewn, and automatically perform a sewing process.

2. Description of the Related Art

There is a sewing apparatus including a so-called embroidery sewing machine, which is provided with a built-in microcomputer containing a CPU or which is connected with an external computer so as to control the sewing machine by using the external computer, so that the sewing machine can perform various processes, such as an automatic sewing operation of a desired embroidery, for example, just by selecting a pattern to be embroidered by the use of a touch panel etc., on the sewing machine or by selecting it on the external computer.

In the above mentioned sewing apparatus having the touch panel, all switches, keys, buttons or the like on the touch panel are displayed with a single color (or a monochrome) when the pattern to be embroidered and a position of a sewing needle (that is, a position where the embroidery or the like is actually sewn) are selected or set on the touch panel, for example.

In the above mentioned sewing apparatus controlled by the external computer, all switches, keys, buttons or the like used for the control on a display picture plane on the external computer for the control of the sewing machine are displayed with the single color (or the monochrome).

However, if the selections of the embroidery and the like are executed by using the touch panel, on which the switches etc., are displayed with the single color, since all of the colors of the switches etc., are same to each other, it is difficult to identify the switches etc., corresponding to the different kinds of sewing patterns. Hence, the operability is certainly degraded, and there is a probability that a switch etc., for a sewing pattern which is not desired by the user may be erroneously operated and that the undesired pattern is sewn.

SUMMARY OF THE INVENTION

The present invention is proposed in view of the above mentioned problems. It is therefore an object of the present invention to provide a sewing apparatus, which can clearly identify switches, keys, buttons or the like which correspond to various kinds of sewing patterns respectively, so as to improve an operability and prevent an erroneous operation from being performed.

The above object of the present invention can be achieved by a sewing apparatus provided with: a stitch forming device; a driving device for driving the stitch forming device; a controller for controlling the driving device; a displaying device such as an LCD device including a plurality of display segments, each of which indicates information to control a sewing process through the controller, on a surface of the displaying device, the display segments being divided into a plurality of segment groups, each of which includes at least one display segment, on the basis of a predetermined criterion; and a display controlling device such as a CPU for controlling the displaying device to display thereon all of the at least one segment belonging to one of the segment groups and all of the at least one segment belonging to another of the segment groups so as to be visually differentiated from each other.

According to the sewing apparatus of the present invention, the display segments are divided into a plurality of segment groups on the basis of a predetermined criterion in advance of the operation. In operation, by the displaying device under the control of the display controlling device, all of the at least one segment belonging to one of the segment groups and all of the at least one segment belonging to another of the segment groups are displayed so as to be visually differentiated from each other.

Accordingly, by correlating the segment groups with the kinds of the sewing patterns classified in advance i.e., the sewing pattern groups classified on the basis of the predetermined criterion, it is possible to easily differentiate the display segments such as switches, keys, buttons and the like, which are displayed on the displaying device and which belong to respective one of the segment groups, from each other visually by virtue of the different display manners such as different colors, different tones, different line thickness, different brightness and the like, assigned to respective one of the segment groups. Therefore, it is possible to prevent an erroneous operation due to the confusing or misleading display manners of the display segments from being performed, and the operability of the sewing apparatus can be improved.

In one aspect of the sewing apparatus, the display segments comprise a plurality of areas respectively into which one picture plane is divided, each of the areas corresponding to the information to control the sewing process.

According to this aspect, since each of the display segments are in one-to-one correspondence with the information to control the sewing process, it is possible to prevent an erroneous operation due to the confusing or misleading display manners of the information to control the sewing process from being performed.

In another aspect of the sewing apparatus, the display controlling device controls the displaying device to display the at least one segment belonging to one of the segment groups and the at least one segment belonging to another of the segment groups with a boundary line therebetween.

According to this aspect, since the display segments in different segment groups are divided from each other on the display device with the boundary line, it is possible to prevent an erroneous operation due to the confusing or misleading display manners of the display segments from being performed.

In another aspect of the sewing apparatus of the present invention, the display controlling device controls the displaying device to display thereon all of the at least one segment belonging to one of the segment groups in a first display manner and all of the at least one segment belonging to another of the segment groups in a second display manner, which is different from the first display manner.

According to this aspect, in operation, by the displaying device under the control of the display controlling device, all of the display segment or segments belonging to one of the segment groups is displayed in the first display manner while all of the display segment or segments belonging to another of the segment groups is displayed in the second display manner, so that the display segment or segments displayed in the first display manner can be visually differentiated from the display segment or segments displayed in the second display manner.

In this aspect, the display controlling device may control the displaying device to display thereon all of the at least one segment belonging to one of the segment groups in one color and all of the at least one segment belonging to another of the segment groups in another color.

Alternatively, the display controlling device may control the displaying device to display thereon all of the at least one segment belonging to one of the segment groups in one tone and all of the at least one segment belonging to another of the segment groups in another tone.

In another aspect of the sewing apparatus of the present invention, the displaying device comprises a switch panel such as a touch panel, the display segments comprise switches respectively on the surface of the switch panel, for selecting one of sewing patterns to be sewn in the sewing process, and the switches are divided into a plurality of switch groups as the segment groups on the basis of the predetermined criterion.

According to this aspect, the switches for selecting one of the sewing patterns on the switch panel are divided into a plurality of switch groups on the basis of the predetermined criterion in advance of the operation. In operation, by the displaying device under the control of the display controlling device, all of the switch or switches belonging to one of the switch groups is displayed in the first display manner while all of the switch or switches belonging to another of the switch groups is displayed in the second display manner, so that the switch or switches displayed in the first display manner can be visually differentiated from the switch or switches displayed in the second display manner.

Accordingly, it is possible to easily differentiate the switches, which are displayed on the switch panel and which belong to respective one of the switch groups, from each other visually by virtue of the different display manners. In this display condition, the switches are operated so as to select one of the sewing patterns. Therefore, it is possible to prevent an erroneous operation due to the confusing or misleading display manners of the switches on the switch panel from being performed, and the operability of the sewing apparatus can be certainly improved.

In this aspect having the switch panel, the switch panel may comprise a color switch panel, the switches may comprise transparent switches respectively, the transparent switches may be divided into the switch groups on the basis of kinds of the sewing patterns corresponding to the transparent switches respectively, each of the switch groups including at least one transparent switch, and the display controlling device may comprise a color display controlling device for controlling the displaying device to perform a color display on the color switch panel by using one color for all of the at least one transparent switch belonging to one of the switch groups and by using another color for all of the at least one transparent switch belonging to another of the switch groups.

Thus, it is possible to easily differentiate the transparent switches, which are displayed on the color switch panel and which belong to respective one of the switch groups, from each other visually by virtue of the different colors assigned to respective one of the switch groups. In this display condition, the transparent switches are operated so as to select one of the sewing patterns. Therefore, it is possible to prevent an erroneous operation due to the confusing or misleading colors of the transparent switches on the color switch panel from being performed, and the operability of the sewing apparatus can be more certainly improved.

In this aspect having the color switch panel also, the at least one transparent switch corresponding to a same kind of the sewing pattern may constitute a same switch group.

Thus, since the kinds of the sewing patterns are in one-to-one correspondence with the switch groups, to each of which different colors are assigned, the operability of the sewing apparatus can be further improved.

In this aspect having the color switch panel also, the at least one transparent switch corresponding to straight stitching may constitute one switch group, the at least one transparent switch corresponding to zigzag stitching may constitute another switch group, the at least one transparent switch corresponding to over casting may constitute another switch group, and the at least one transparent switch corresponding to blind stitching may constitute another switch group.

Thus, it is possible to easily differentiate the at least one transparent switch for straight stitching, zigzag stitching, over casting and blind stitching from each other visually by virtue of the different colors assigned to respective one of the switch groups. Therefore, it is possible to prevent the straight stitching operation, the zigzag stitching operation, the over casting operation and the blind stitching operation from being erroneously performed due to the confusing or misleading colors of the transparent switches, and the operability of the sewing apparatus can be certainly improved.

In this aspect having the color switch panel also, the at least one transparent switch corresponding to the sewing pattern sewn by using a predetermined presser foot may constitute a switch group.

Thus, since the presser feet used for the sewing patterns are in one-to-one correspondence with the switch groups, to each of which different colors are assigned, it is possible to prevent the presser foot from being erroneously used due to the confusing or misleading colors of the transparent switches, and the operability of the sewing apparatus can be further improved.

In another aspect of the sewing apparatus of the present invention, the sewing apparatus is further provided with: at least one sewing machine including the stitch forming device and the driving device; and a controlling unit such as a computer externally connected to the at least one sewing machine and including the controller, the displaying device and the display controlling device.

According to this aspect, in operation, the sewing machine including the stitch forming device and the driving device is controlled by the controller included in the controlling unit, which is externally connected to the sewing machine. The displaying device and the display controlling device are also included in the controlling unit. Therefore, in the sewing apparatus in which the controlling unit externally controls one or a plurality of sewing machines, it is possible to prevent an erroneous operation due to the confusing or misleading display manners of the display segments from being performed, and the operability of the sewing apparatus can be improved.

In another aspect of the sewing apparatus of the present invention, the display controlling device controls the displaying device to display symbols indicating sewing patterns on the display segments respectively in a differentiated manner for each of the segment groups.

According to this aspect, by the displaying device under the control of the display controlling device, the symbols indicating the sewing patterns are displayed in the different display manners for each kind of the segment groups. Accordingly, since it is possible to easily recognize the relationship between the symbol and the sewing pattern, a preparation for the sewing process can be easily performed.

In this aspect displaying the symbol, the display segments may be divided into the segment groups on the basis of kinds of presser feet, each of which is used for the sewing process. And that, the display controlling device may control the displaying device to display the symbols indicating sewing patterns sewn in correspondence with the kinds of the presser feet.

Thus, the symbols indicating the sewing patterns are displayed in the different display manners for each kind of the presser feet. Accordingly, since it is possible to easily recognize the relationship between the sewing pattern to be sewn and the presser foot to be used for this sewing pattern, a preparation for the sewing process can be easily performed.

In this aspect of employing the symbol, the sewing patterns may comprise practical sewing patterns.

Alternatively, the sewing patterns may comprise embroidery patterns.

In this aspect displaying the symbols, the display controlling device may control the displaying device to display the symbols indicating the sewing patterns on a single picture plane on the displaying device.

Thus, since, by the displaying device under the control of the display controlling device, the symbols indicating the sewing patterns are displayed on a single picture plane, even in case that there exist various kinds of sewing patterns, it is possible to easily recognize the relationship between the symbol and the sewing pattern. Therefore, the preparation for the sewing process can be still easily performed in such a case.

In this aspect displaying the symbols also, the displaying device may comprise a switch panel such as a touch panel, the display segments may comprise switches respectively on the surface of the switch panel, for selecting one of the sewing patterns to be sewn in the sewing process while displaying the symbols on the switches respectively, and the switches may be divided into a plurality of switch groups as the segment groups on the basis of the predetermined criterion.

Thus, since the symbols indicating the sewing patterns are displayed on the switches respectively in the different display manners for each kind of the presser feet, it is possible to select one of the sewing patterns to be sewn while easily correlating the sewing patterns with the presser feet.

In this aspect displaying the symbols also, the displaying device may display the symbols in monochrome.

Thus, since the symbols are displayed with the monochrome in different display manners such as different tones, different line thickness, different brightness and the like, assigned to respective one of the segment groups, it is possible to easily recognize the relationship between the sewing pattern to be sewn and the presser foot to be used for this sewing pattern. Especially, it is possible to reduce the cost as compared with the case of employing the displaying device capable of full-color-displaying.

Alternatively, the displaying device may display the symbols in full color.

Thus, since the symbols are displayed with the full color in different display manners such as different colors, assigned to respective one of the segment groups, it is possible to easily recognize the relationship between the sewing pattern to be sewn and the presser foot to be used for this sewing pattern.

In this aspect displaying the symbols also, the sewing apparatus may be further provided with a selecting device for selecting one of the sewing patterns to be sewn in the sewing process by selecting one of the symbols displayed on the display segments respectively, the display controlling device controlling the displaying device to display (i) the symbols indicating the sewing patterns in one of the segment groups and (ii) the symbols indicating the sewing patterns in another of the segment groups, in the differentiated manner from each other.

Thus, by the displaying device under the control of the display controlling device, (i) the symbols indicating the sewing patterns in one of the segment groups and (ii) the symbols indicating the sewing patterns in another of the segment groups are displayed in the differential manner from each other. Accordingly, since it is possible to more easily recognize the relationship between the symbol and the sewing pattern to be sewn, a preparation for the sewing process can be more easily performed.

In this aspect displaying the symbols also, the display controlling device may control the displaying device to collectively display the symbols, which correspond to the sewing patterns in respective one of the segment groups, on a single picture plane on the display device.

Thus, by the displaying device under the control of the display controlling device, the symbols, which correspond to the sewing patterns in respective one of the segment groups, are displayed on the single picture plane on the display device. Accordingly, it is possible to easily recognize the sewing patterns to be sewn.

The nature, utility, and further features of this invention will be more clearly apparent from the following detailed description with respect to preferred embodiments of the invention when read in conjunction with the accompanying drawings briefly described below.

BRIEF DESCRIPTION OF THE DRAWINGS

FIG. 5A is a diagram showing a data structure of a data address header for a picture plane displaying process in the embodiment;

FIG. 5B is a diagram showing a data structure of a main body of the data for the picture plane displaying process in the embodiment;

DETAILED DESCRIPTION OF THE PREFERRED EMBODIMENTS

Preferred embodiments of the present invention will be explained below with reference to the drawings.

At first, an appearance of a sewing machine of the embodiment, which is an embroidery sewing machine, is explained with reference to FIG. 1.

Figure 1:
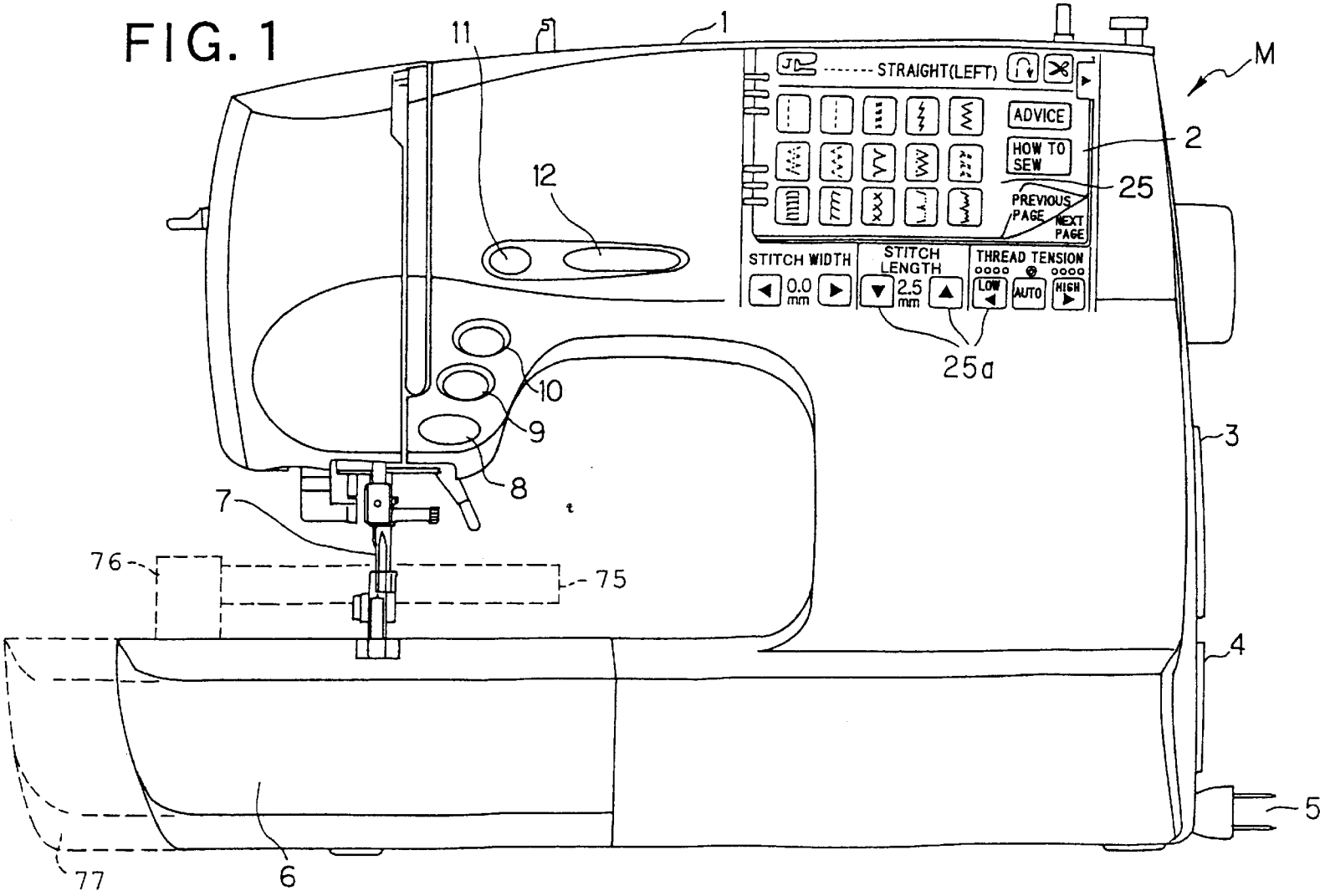
FIG. 1 is a side view showing a schematic configuration of an embroidery sewing machine as an embodiment of the present invention.

In FIG. 1, an embroidery sewing machine M is provided, on a main body 1, with: an LCD (Liquid Crystal Display) panel 2 as one example of a displaying device for displaying an operation status etc., of the embroidery sewing machine M during sewing various embroideries; a card connector 3 to which an external ROM (Read Only Memory) card etc., for storing various embroidery patterns set in advance is to be connected; a communication connector 4 for performing transmission and reception of data by connecting an external computer with the embroidery sewing machine M; an electric source cable 5; a cloth fixing platform 6 on which a cloth is fixed during sewing; a sewing needle 7 for actually sewing; a start/stop button 8 operated when the sewing operation is to be started and stopped; a backstitch button 9 operated when a backstitch is performed; a needle up and down button 10 operated when the sewing needle 7 is manually moved up and down; a thread cutting button 11 operated when a thread is cut after sewing etc.; and a motor speed control 12 for adjusting a rotation speed of a motor to move up and down the sewing needle 7.

Incidentally, on a surface of the LCD panel 2, a touch panel 25 is disposed as one example of a switch panel including one or more keys 25*a* to perform various inputting operations.

Further, in the cloth fixing platform 6, a rotating motor for moving the cloth fixed on the cloth fixing platform 6 within a X-Y plane perpendicular to the moving direction of the sewing needle 7 in correspondence with the pattern to be embroidered etc., a loop taker for storing a bobbin thread and so on are accommodated.

When actually sewing a sewing pattern, in addition to the constitutional elements of the embroidery sewing machine M as indicated by a solid line in FIG. 1, the embroidery sewing machine M is provided, as indicated by a dashed line in FIG. 1, with: an embroidery frame 72 for fixing a cloth to which a sewing pattern is to be embroidered; a moving body 71 for moving the embroidery frame 72 in a direction perpendicular to the paper surface of FIG. 1 in correspondence with the sewing pattern to be sewn; and an embroidering device 70 for moving the embroidery frame 72 in a direction parallel to the paper surface of FIG. 1 by moving the moving body 71 in a direction parallel to the paper surface of FIG. 1 in correspondence with the sewing pattern to be sewn. Among those constitutional elements, within the embroidery device 70, an X direction driving motor 23 and a Y direction driving motor 24, which will be described later, for moving the embroidery frame 72 within a plane perpendicular to the moving direction of the sewing needle 7 by driving the moving body 71 and moving the moving body 71 in a direction perpendicular to the paper surface of FIG. 1.

Incidentally, in case that the embroidery device 70 is not used, the cloth is moved in synchronization with the up and down movement of the sewing needle 7 and the needle bar by means of a known feed dog mechanism equipped in the cloth fixing platform 6.

Next, the internal structure of the embroidery sewing machine M is explained with reference to a block diagram shown in FIG. 2.

The operation of the embroidery sewing machine M is concentrically controlled by a signal processing unit 15 within the embroidery sewing machine M.

Figure 2:
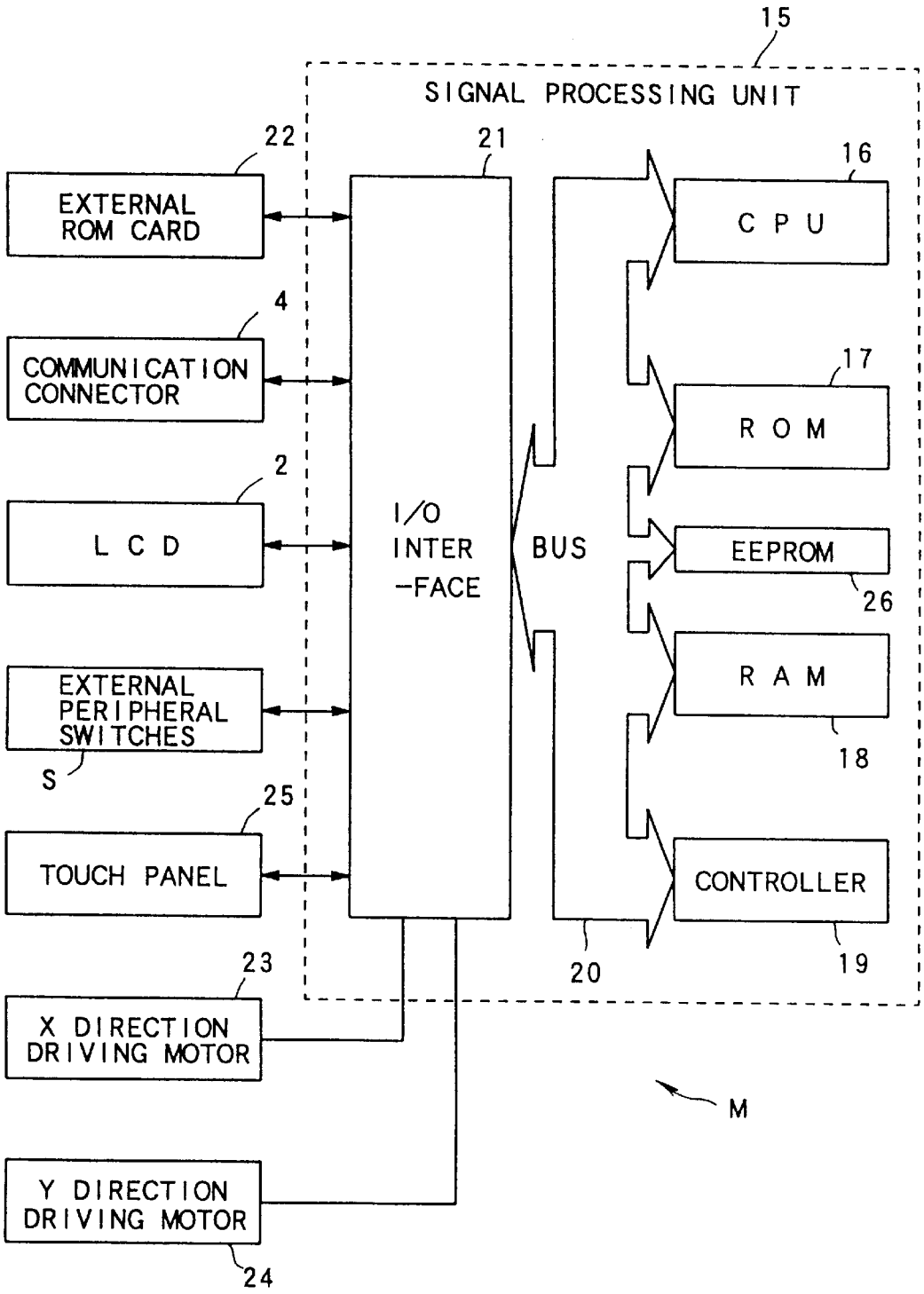
FIG. 2 is a block diagram showing an inner schematic configuration of the embroidery sewing machine.

In FIG. 2, the signal processing unit 15 is provided with: a CPU 16 as one example of a display controlling device and a processing device for actually performing a control of the embroidery sewing machine M; a ROM 17 for storing a control program for operating the CPU 16 etc., in advance in a readable manner; a RAM (Random Access Memory) 18 for temporarily storing data necessary for controlling the embroidery sewing machine M etc., in a readable manner; a communication bus 20 for connecting each constitutional element within the signal processing unit 15; a controller 19 for controlling the connections between the constitutional elements respectively by the communication bus 20 and an input/output (I/O) interface 21; and the input/output interface 21 for connecting the signal processing unit 15 with external constitutional elements.

Then, the signal processing unit 15 is connected through the input/output interface 21 with: an external ROM card 22 which is inserted into the card connector 3 (refer to FIG. 1); the communication connector 4; the LCD panel 2; external peripheral switches S (i.e., which is a generic name of the start/stop button 8, the backstitch button 9, the needle up and down button 10 etc., shown in FIG. 1 which are the buttons for operating the embroidery sewing machine M from the external); the touch panel 25; the X direction driving motor 23; the Y direction driving motor 24; and so on.

Incidentally, the operation of the embroidery sewing machine M of the present embodiment is performed under the control of the CPU 16. The program corresponding to the processing operation indicated by each flow chart, which will be described later, and necessary for the control of the CPU 16 is stored in the ROM 17 in advance.

In the signal processing unit 15, there is equipped an EEPROM (Electrically Erasable/Programmable ROM) 26 for storing peculiar information such as the repair history information related to the embroidery sewing machine M. The EEPROM 26 is adapted to electrically re-write the storage content and to maintain the storage content even after the electric source for the embroidery sewing machine M itself is turned off.

Next, the display implementation of the LCD panel 2 and the operation in relation to it of the embroidery sewing machine M will be explained below with reference to FIG. 3A to FIG. 4B.

Figure 3A:
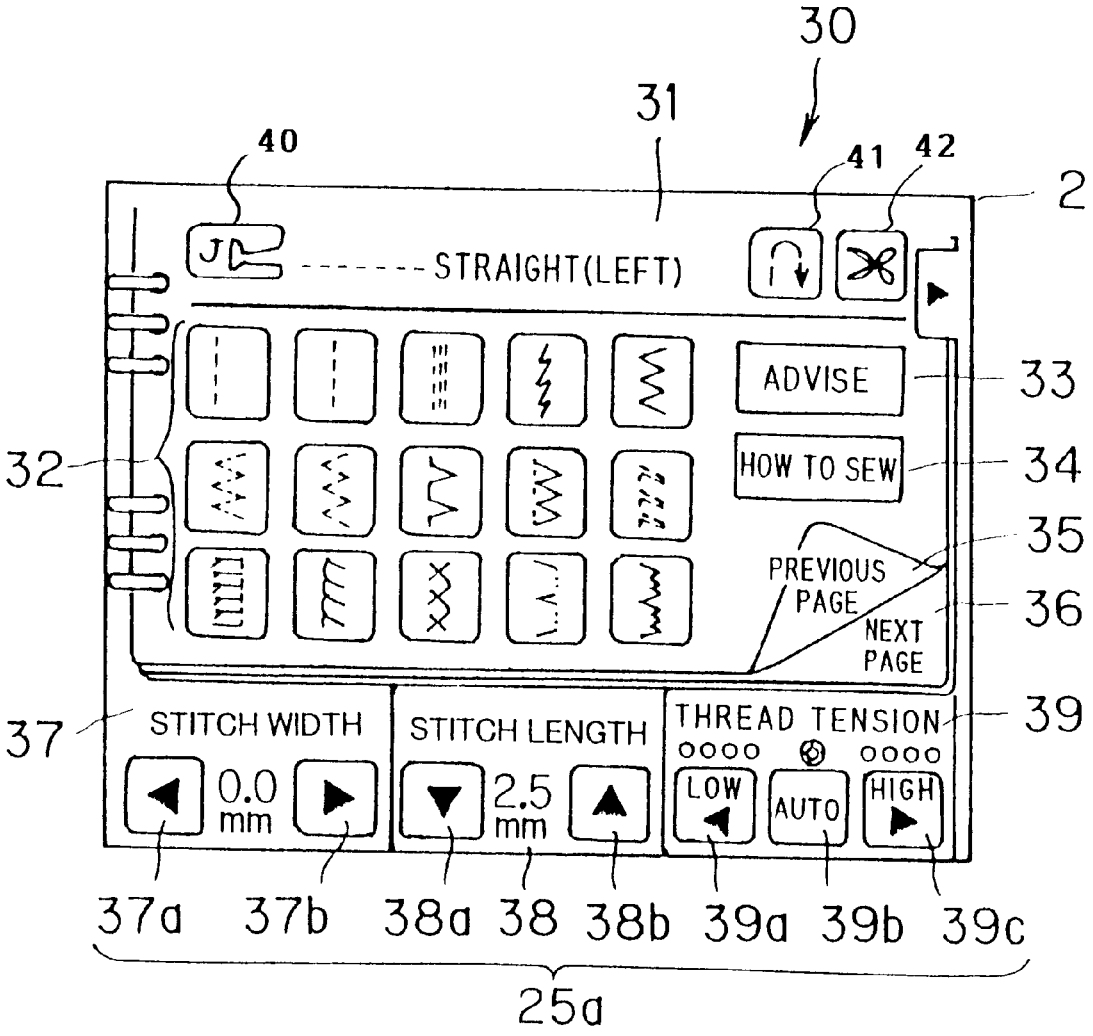
FIG. 3A is a plan view of one example of a picture plane for a selection in the embodiment.
Figure 3B:
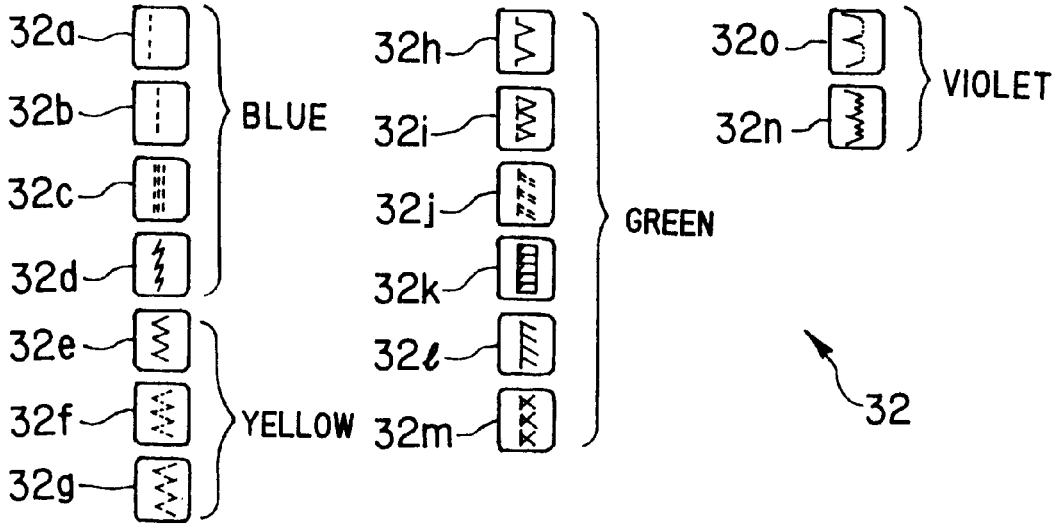
FIG. 3B is a plan view of only keys related to the pattern selection extracted from the picture plane of FIG. 3A.

At first, a picture plane for the sewing operation displayed on the LCD panel 2 is explained with reference to FIG. 3A and FIG. 3B. FIG. 3A shows one example of the picture plane including keys (i.e., buttons each constituted by one transparent switch) to select the pattern to be sewn. FIG. 3B shows only the keys related to the pattern selection extracted from the picture plane of FIG. 3A.

As shown in FIG. 3A, a selection picture plane 30 displayed on the LCD panel 2 when the sewing pattern is to be selected includes: a selection pattern display region 31 to display a presently selected sewing pattern; a plurality of pattern selection keys 32 operated when a pattern to be sewn is selected; an advice key 33 operated when information with regard to a method of using the embroidery sewing machine M is to be displayed; a how to sew key 34 operated when how to sew is to be displayed; a previous page key 35 operated when a picture plane for a pattern selection located at a previous page on the display picture plane is to be displayed; a next page key 36 operated when a picture plane for a pattern selection located at a next page on the display picture plane is to be displayed; a stitch width adjustment region 37 on which keys to adjust a stitch width of the sewing needle 7 are displayed; a stitch length adjustment region 38 on which keys to adjust a stitch length are displayed; a thread tension adjustment region 39 on which keys to adjust a tension of a sewn thread are displayed; a presser foot symbol 40 indicating a presser foot presently selected among a plurality of presser feet for pressing the cloth during sewing; a backstitch key 41 operated when the backstitch is to be performed; and a thread cutting key 42 operated when the thread cutting is to be performed.

Among the above mentioned regions, in the stitch width adjustment region 37, a stitch width increase key 37*b* operated when the stitch width is to be increased and a stitch width decrease key 37*a* when the stitch width is to be decreased are displayed.

In the length adjustment region 38, an extension key 38*b* operated when the stitch length is to be extended and a reduction key 38*a* operated when the stitch length is to be reduced are displayed.

In the thread tension adjustment region 39, a high key 39*c* operated when the thread tension is to be made high, a low key 39*a* operated when the thread tension is to be made low and an automatic key 39*b* operated when the thread tension is to be initialized and automatically set are displayed.

Transparent switches constituted by transparent electrodes are disposed at the positions of the touch panel 25 corresponding to the respective keys of the selection picture plane 30.

As a presser foot symbolized by the presser foot symbol 40, there are a presser foot N, a presser foot A, a presser foot R, a presser foot Q and a presser foot M as described later other than a presser foot J shown in FIG. 3A as an example. The presser foot J, the presser foot N, the presser foot A, the presser foot R, the presser foot Q and the presser foot M have utilities different from each other.

Moreover, the above described keys are displayed with colors different from each other depending upon the functions of the keys or the kinds to which the patterns corresponding to the keys belong.

Namely, the pattern selection keys 32 are displayed with colors different from each other as described later for each of the kinds of patterns corresponding to the keys. For example, the advice key 33 and the how to sew key 34 are displayed with orange color. The previous page key 35 and the next page key 36 are displayed with yellowish green color. The increase key 37*b* and the decrease key 37*a* are displayed with dark brown color. The extension key 38*b* and the reduction key 38*a* are displayed with light purple. The high key 39*c*, the low key 39*a* and the automatic key 39*b* are displayed with block color. The presser foot symbol 40 and the selection pattern display region 31 are displayed with red color. The backstitch key 41 and the thread cutting key 42 are displayed with brown color.

As shown in FIG. 3B, in the pattern selection keys 32, a straight stitch (left) key 32*a*, a straight stitch (middle) key 32*b*, a triple stitch key 32*c* and a stretch stitch key 32*d*, by which patterns belonging to a straight stitching pattern group are specified, are respectively displayed by using the same blue. A zigzag key 32*e*, a dashed-line zigzag key 32*f* and a two-point zigzag key 32*g*, by which patterns belonging to a zigzag stitching pattern group are specified, are respectively displayed by using the same yellow. Keys 32*h* to 32*m*, by which patterns belonging to an over casting pattern group are specified, are respectively displayed by using the same green. Keys 32*n* and 32*o*, by which patterns belonging to a blind stitching pattern group are specified, are respectively displayed by using the same violet.

Figures 4A, 4B:
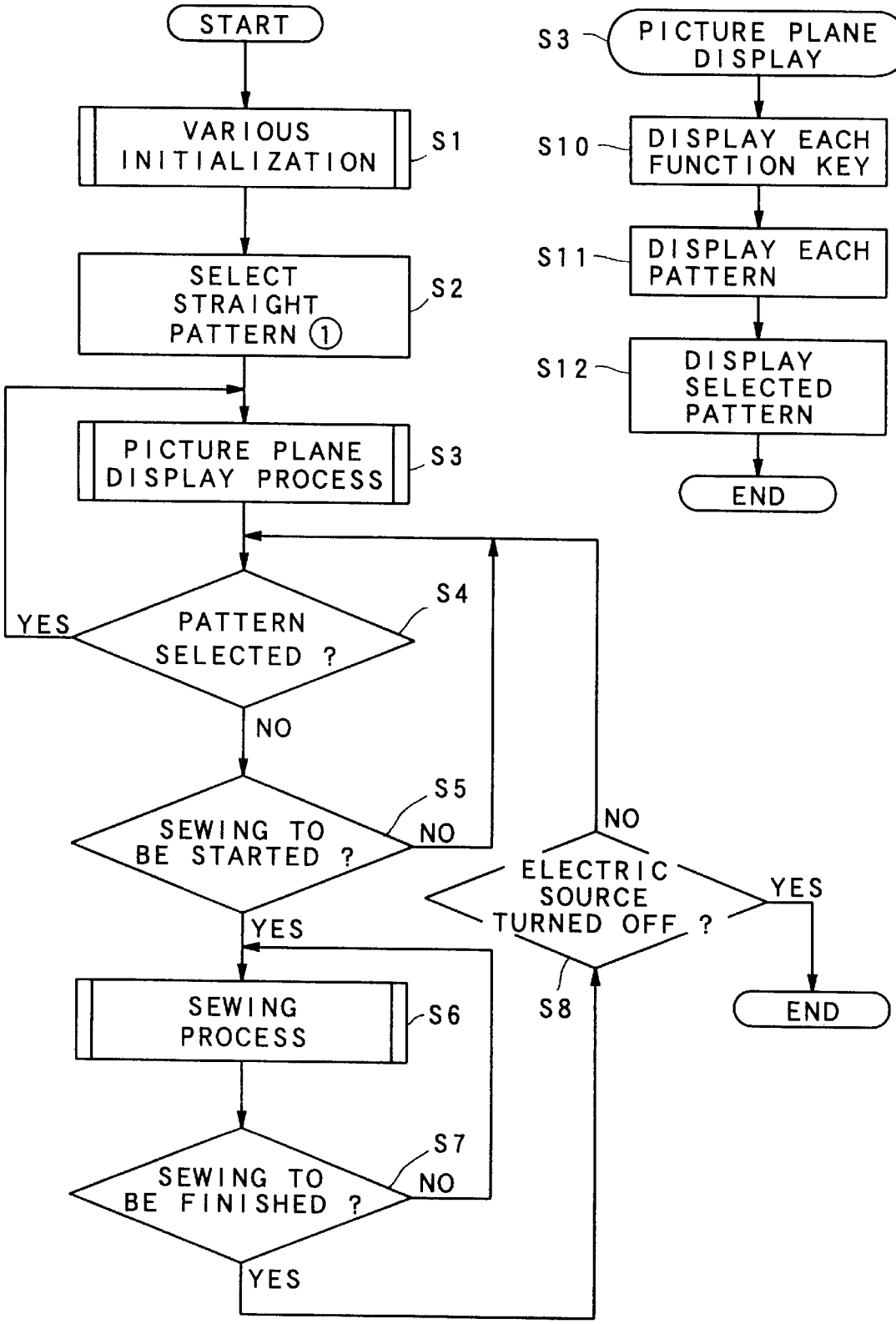
FIG. 4A is a flowchart showing a whole operation of the embroidery sewing machine in the embodiment.
FIG. 4B is a flowchart showing a detail operation in a picture plane displaying process of the embroidery sewing machine in the embodiment.

Next, the sewing operation in the embroidery sewing machine M is explained with reference to FIG. 4A and FIG. 4B. FIG. 4A is a flowchart showing the whole sewing process, and FIG. 4B is a flowchart showing the detail portion of the picture plane displaying process in FIG. 4A.

As shown in FIG. 4A, in the sewing operation of the embroidery sewing machine M, when the electric source of the embroidery sewing machine M is firstly turned on, various initial settings (e.g., the initialization of the RAM 18) are executed (Step S1). Then, a straight pattern ① is selected as an initial setting value in the sewing process (Step S2).

Then, the picture plane displaying process is performed which displays a picture plane to select a pattern (e.g., the pattern exemplified in FIG. 3A) to be sewn and the like on the LCD panel 2 (Step S3). The detail portion of this picture plane displaying process will be described later.

Then, it is judged whether or not the process of selecting the sewing pattern is executed by using the displayed picture plane and the touch panel 25 disposed on the surface of the picture plane (Step S4). If the selection process is executed (Step S4; YES), the operational flow returns to the step S3 so as to display the picture plane corresponding to the executed selection process. On the other hand, if the selection process is not executed or if the selection process is ended (Step S4; NO), it is judged whether or not the operation to indicate the start of the sewing operation is performed through the start/stop button 8 and the like (Step S5).

Then, if the start of the sewing operation is not instructed (Step S5; NO), the operational flow returns to the step S4, and the pattern selection is performed. If the start of the sewing operation is instructed (Step S5; YES), the sewing process is executed on the basis of the information selected on the LCD panel 2 (Step S6). After that, it is judged whether or not the finish of the sewing process is instructed as the start/stop button 8 is again operated (Step S7). If the finish of the sewing process is not instructed (Step S7; NO), the operational flow returns to the step S6, and the sewing process is continued. If the finish of the sewing process is instructed (Step S7; YES), it is judged whether or not the electric source of the sewing machine M is turned off (Step S8). If the electric source is turned off (Step S8; YES), the process is ended directly. If the electric source is not turned off (Step S8; NO), the operational flow returns to the step S4 so as to select a next pattern and the like.

Next, the picture plane displaying process at the step S3 is explained in detail with reference to FIG. 4B.

As shown in FIG. 4B, in the picture plane displaying process, the color data, which is stored in the ROM 17 and will be described later, is firstly used to display the corresponding function keys respectively (that is, the advice key 33, the how to sew key 34, the previous page key 35, the next page key 36, the increase key 37*b*, the decrease key 37*b*, the extension key 38*b*, the reduction key 38*a*, the high key 39*c*, the low key 39*a*, the automatic key 39*b*, the backstitch key 41 and the thread cutting key 42) (Step S10). Then, the color data is used to display the corresponding pattern selection keys 32 respectively (Step S11). Finally, the pattern within the selection pattern display region 31 is displayed with the color corresponding to the selected pattern (Step S12). Then, the operational flow proceeds to the step S4 in FIG. 4A.

Incidentally, the above mentioned process shown in FIG. 4A and FIG. 4B is executed through the CPU 16 by using a program corresponding to the process (which is stored in advance in the ROM 17).

Next, the color data to draw the respective keys and the like by using the respective colors is explained with reference to FIG. 5A and FIG. 5B. The respective data shown in FIG. 5A and FIG. 5B are stored in advance in the ROM 17.

As shown in FIG. 5A, a data address header 50, including lead addresses of memory areas where bit map data and color data to display the respective function keys or the pattern selection keys are stored, is stored in a high order region in the corresponding regions within the ROM 17.

In the case exemplified in FIG. 5A, the data address header 50 includes a display data lead address 50*a* of the presser foot N, a display data lead address 50*b* of the presser foot J, a display data lead address 50*c* of the presser foot A, a display data lead address 50*d* of the presser foot R, a display data lead address 50*e* of the presser foot Q, a display data lead address 50*f* of the presser foot M, a display data lead address 50*g* of the backstitch key 41, a display data lead address 50*h* of the thread cutting key 42, a display data lead address 50*i* of the advice key 33, a display data lead address 50*j* of the how to sew key 34, a display data lead address 50*k* of the decrease key 37*b*, a display data lead address 50*l* of the increase key 37*b*, a display data lead address 50*m* of the reduction key 38*a*, a display data lead address 50*n* of the extension key 38*b*, a display data lead address 50*o* of the low key 39*a*, a display data lead address 50*p* of the automatic key 39*b*, a display data lead address 50*q* of the high key 39*c*, a display data lead address 50*r* of the next page key 36, a display data lead address 50*s* of the previous page key 35, display data lead addresses 50*t*, 50*u* and 50*v* of respective pattern selection keys 32.

When the keys and the like are displayed in the picture plane displaying process at the step S3 in FIG. 4B, the data address header 50 is firstly referred to, so that the lead addresses of the bit map data and the color data of the corresponding keys are retrieved. Then, the selection picture plane 30 is actually drawn and displayed by accessing to the retrieved lead address and using the color data and the bit map data recorded thereat.

Next, the configuration of the color data and the bit map data retrieved by using the data address header 50 is exemplified with reference to FIG. 5B. The color data and the bit map data are stored as data 60 in a lower order region of the ROM 17. For example, color code data 60*a* of the presser foot N, display bit map (BMP) data 60*b* of the presser foot N, color code data 60*c* of the presser foot J, display bit map data 60*d* of the presser foot J, color code data 60*e* of the backstitch key 41, display bit map data 60*f* of the backstitch key 41, color code data 60*g* and 60*i* of the respective pattern selection keys 32, display bit map data 60*h* and 60*j* and the like are stored in the data 60. Then, when the respective keys are actually drawn and displayed, the design instructed by the display bit map data is drawn by using the color specified by the color code data.

As explained above, according to the embroidery sewing machine M in the embodiment, a plurality of pattern selection keys 32 are classified on the basis of the kinds of the sewing patterns to which the respective pattern selection keys 32 correspond. The colors displayed for the kinds of the respective sewing patterns are different from each other. Thus, it is possible to easily identify the corresponding pattern selection key 32 in response to the sewing pattern.

A plurality of pattern selection keys 32 are classified into the pattern selection key groups corresponding to the same kinds of the sewing patterns as one set or category. Thus, the pattern selection keys 32 corresponding to the sewing patterns in the different kinds from each other are displayed by using the different display colors. Hence, it is possible to easily distinguish between the pattern selection keys 32 corresponding to the same kinds of the sewing patterns, to thereby improve the operability of the embroidery sewing machine M.

Moreover, a plurality of pattern selection keys 32 are classified into: the pattern selection keys 32 corresponding to the straight stitching as one set; the pattern selection keys 32 corresponding to the zigzag stitching as one set; the pattern selection keys 32 corresponding to the over casting as one set; and the pattern selection keys 32 corresponding to the blind stitching as one set. Hence, it is possible to easily distinguish between the pattern selection keys 32 for each sewing manner.

Incidentally, the configuration in which the single embroidery sewing machine M having the touch panel 25 and the LCD panel 2 is explained in the embodiment. In addition, the present invention can be applied to a sewing apparatus in which a plurality of embroidery sewing machines M are collectively controlled by a computer C servicing as a single controller, as shown in FIG. 6.

Figure 6:
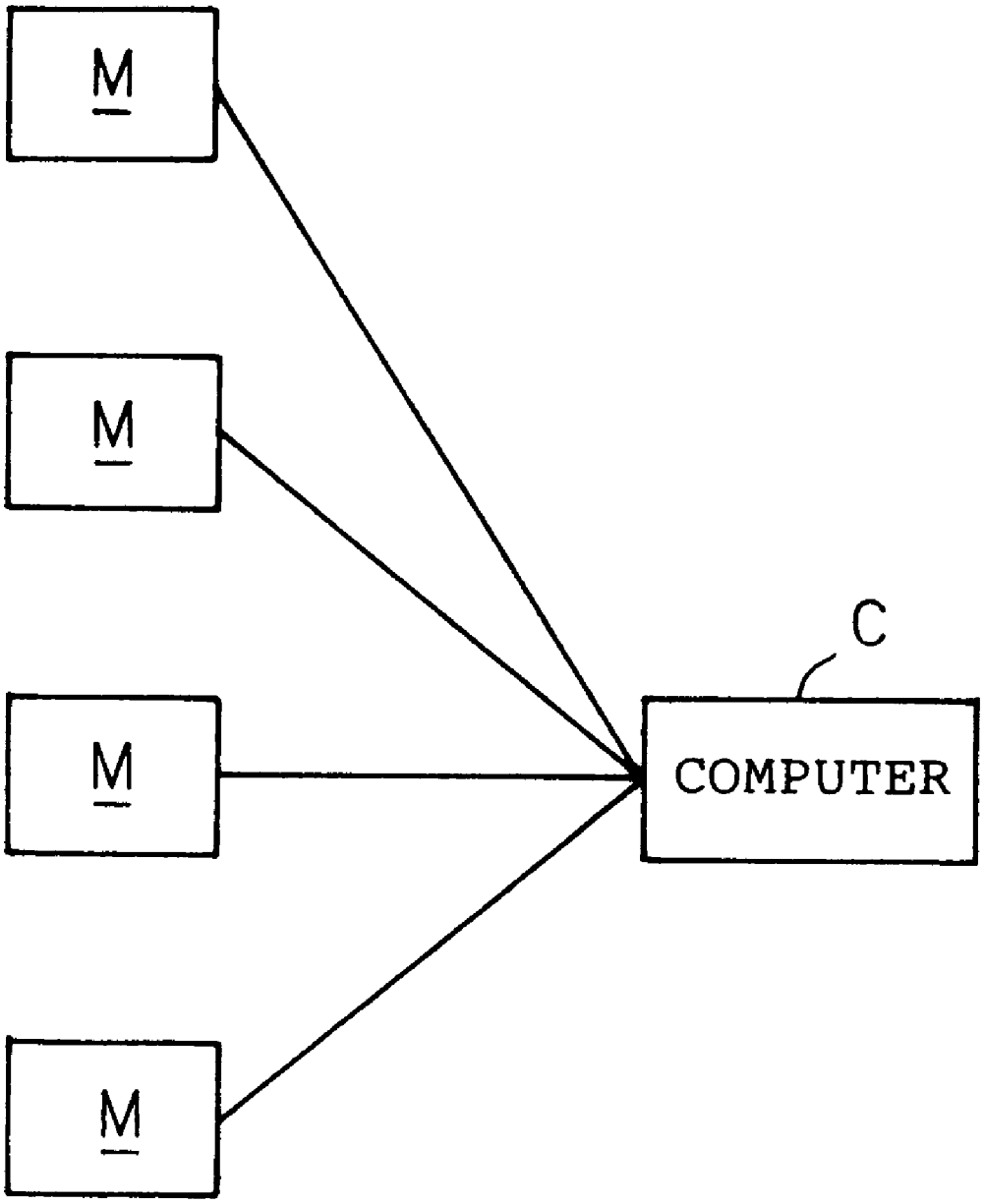
FIG. 6 is a block diagram showing a configuration of a sewing apparatus including a plurality of embroidery sewing machines as a modified embodiment of the present invention.

In FIG. 6, each sewing machine M is collectively controlled through a communication line by the computer C such as a personal computer. In this case, the picture plane shown in FIG. 3A or the like is displayed on a displaying device such as a CRT (Cathode Ray Tube) device or an LCD device of the computer C. It is also possible to construct the sewing apparatus such that some portion of the picture plane shown in FIG. 3A is displayed on a displaying device equipped to each sewing machine M while the remaining or full portion of the picture plane shown in FIG. 3A is displayed on the displaying device of the computer C.

In the above mentioned embodiment, the color classification display of the corresponding key is performed for so-called practical patterns other than the embroidery patterns stored within the embroidery sewing machine M. Alternatively, a color classification display of a corresponding key may be performed for embroidery patterns stored in the external memory such as the ROM card 22. In this case, the color classification groups can be classified on the basis of the kinds of embroidery frames to be used.

Moreover as the manner of classifying the colors of the transparent switches, the color classification may be performed on the basis of the kinds of the above mentioned presser feet, in addition to the above mentioned manners.

That is, the presser foot used for each sewing pattern is predetermined in the sewing machine M in the embodiment. The transparent switches corresponding to the sewing patterns, in which the same presser feet are used, are displayed in an at-a-glance list (i.e., the display condition shown in FIG. 3A) of the sewing patterns by using the same color, on the basis of the kinds of the presser feet. The sewing patterns in which different presser feet are used are displayed by using different colors.

More actually, among the pattern selection keys 32 shown in FIG. 3B, the sewing patterns corresponding to the straight stitch (left) key 32*a*, the straight stitch (middle) key 32*b*, the triple stitch key 32*c*, the stretch stitch key 32*d*, the zigzag key 32*e*, the dashed-line zigzag key 32*f*, the two-point zigzag key 32*g*, the key 32*j*, the key 32*l* and the key 32*m* are respectively sewn by using the same presser foot J. The sewing patterns corresponding to the key 32*h*, the key 32*i* and the key 32*k* are respectively sewn by using the same presser foot G. The sewing patterns corresponding to the key 32*n* and the key 32*o* are respectively sewn by using the same presser foot R. Thus, the sewing patterns maybe displayed using different colors according to the presser feet to be used.

Figure 7:
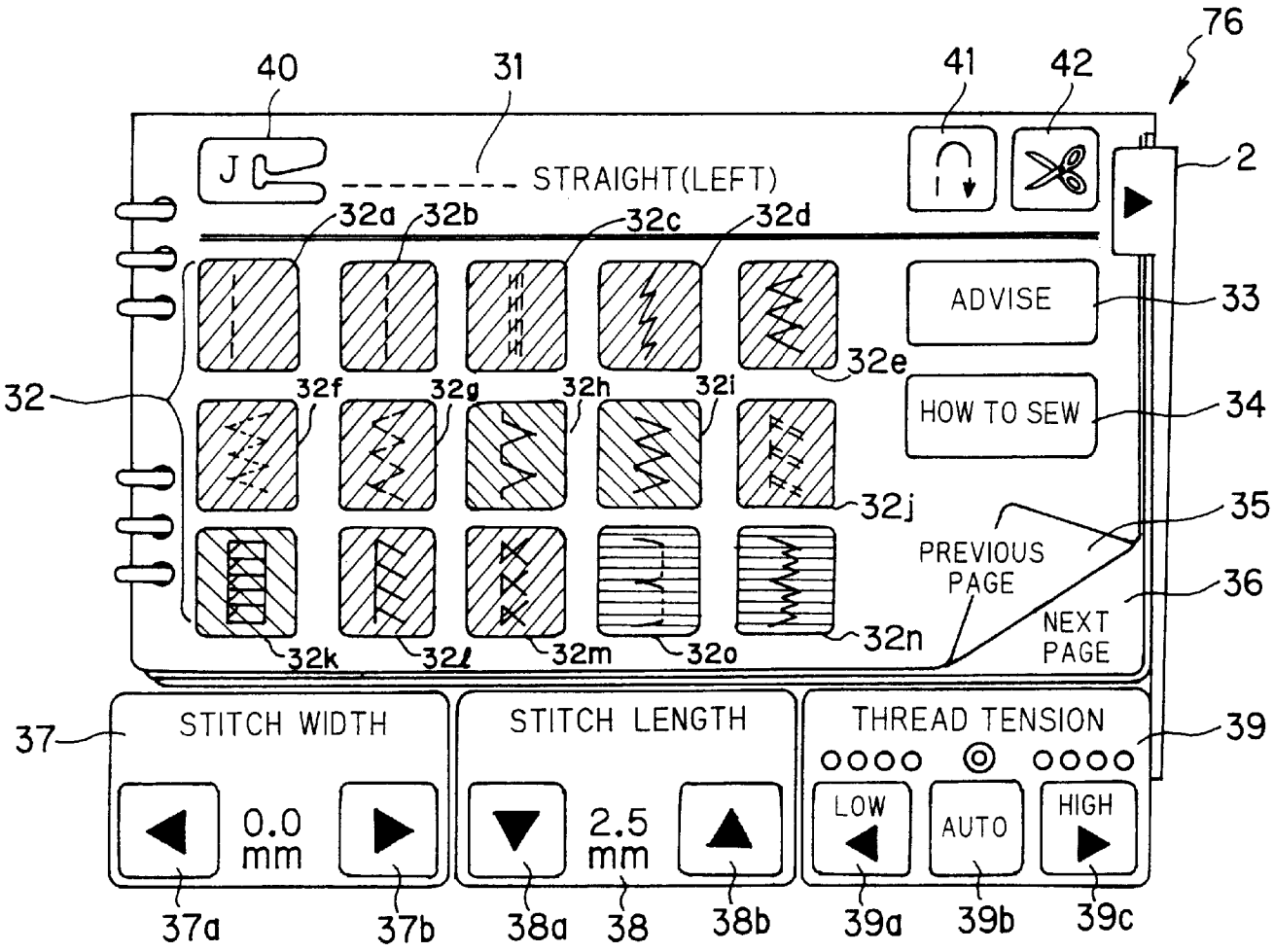
FIG. 7 is a plan view of another example of a picture plane for a selection in the embodiment.

For example, as shown in FIG. 7, a selection picture plane 75 may be displayed such that the straight stitch (left) key 32*a*, the straight stitch (middle) key 32*b*, the triple stitch key 32*c*, the stretch stitch key 32*d*, the zigzag key 32*e*, the dashed-line zigzag key 32*f*, the two-point zigzag key 32*g*, the key 32*i*, the key 32*l* and the key 32*m* are displayed by using the red color, the key 32*h*, the key 32*i* and the key 32*k* are displayed by using the blue color, and that the key 32*n* and the key 32*o* are displayed by using the yellow color.

When the sewing pattern to be sewn is selected, the keys corresponding to other sewing patterns to be sewn by using the same presser foot used for the sewing operation of the selected sewing pattern may be displayed by using the same color, to thereby distinguish them from the sewing patterns in which presser feet different from the above mentioned presser foot are used.

Figure 8:
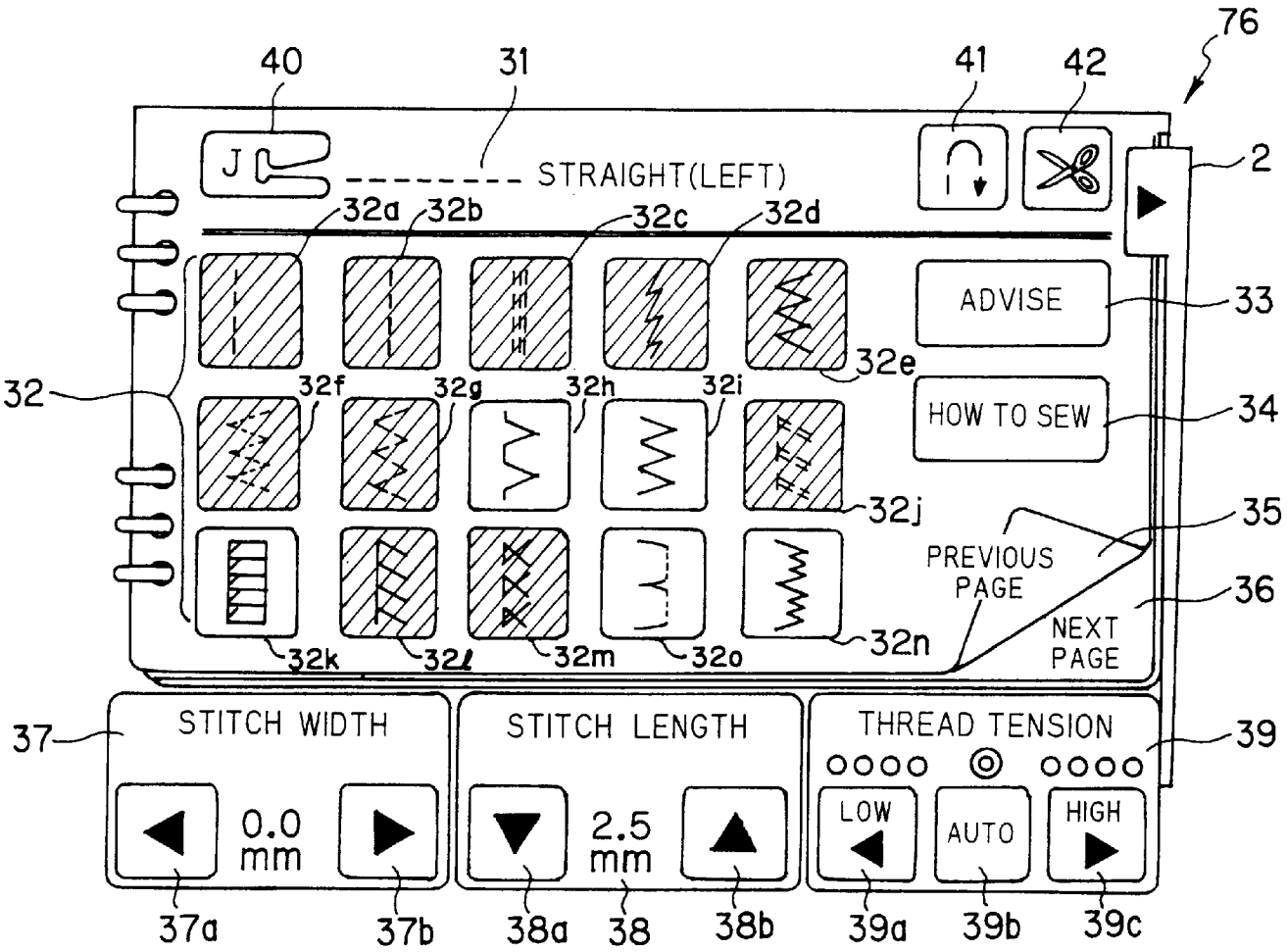
FIG. 8 is a plan view of another example of a picture plane for a selection in the embodiment.

For example, as shown in FIG. 8, a selection picture plane 76 may be displayed such that the straight stitch (left) key 32*a*, the straight stitch (middle) key 32*b*, the triple stitch key 32*c*, the stretch stitch key 32*d*, the zigzag key 32*e*, the dashed-line zigzag key 32*f*, the two-point zigzag key 32*g*, the key 32*j*, the key 32*l* and the key 32*m* are displayed by using the same color, and that other keys are displayed by using the different color or are inversion-displayed.

Figure 9:
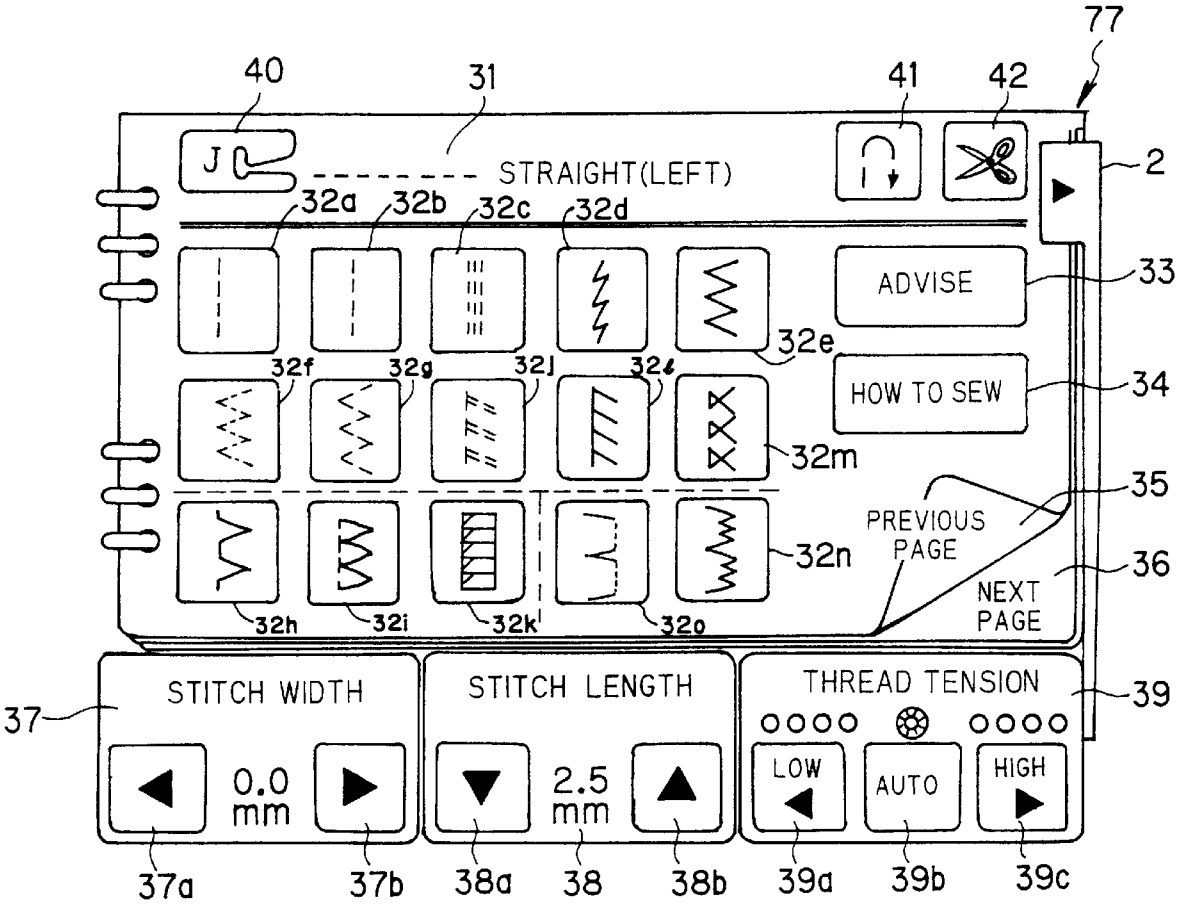
FIG. 9 is a plan view of another example of a picture plane for a selection in the embodiment.

Further, for example, as shown in FIG. 9, a selection picture plane 77 may be displayed such that the keys corresponding to the patterns using the same presser foot are collectively displayed as one set, and that the border line of this one set is indicated by a dashed line.

Figure 10:
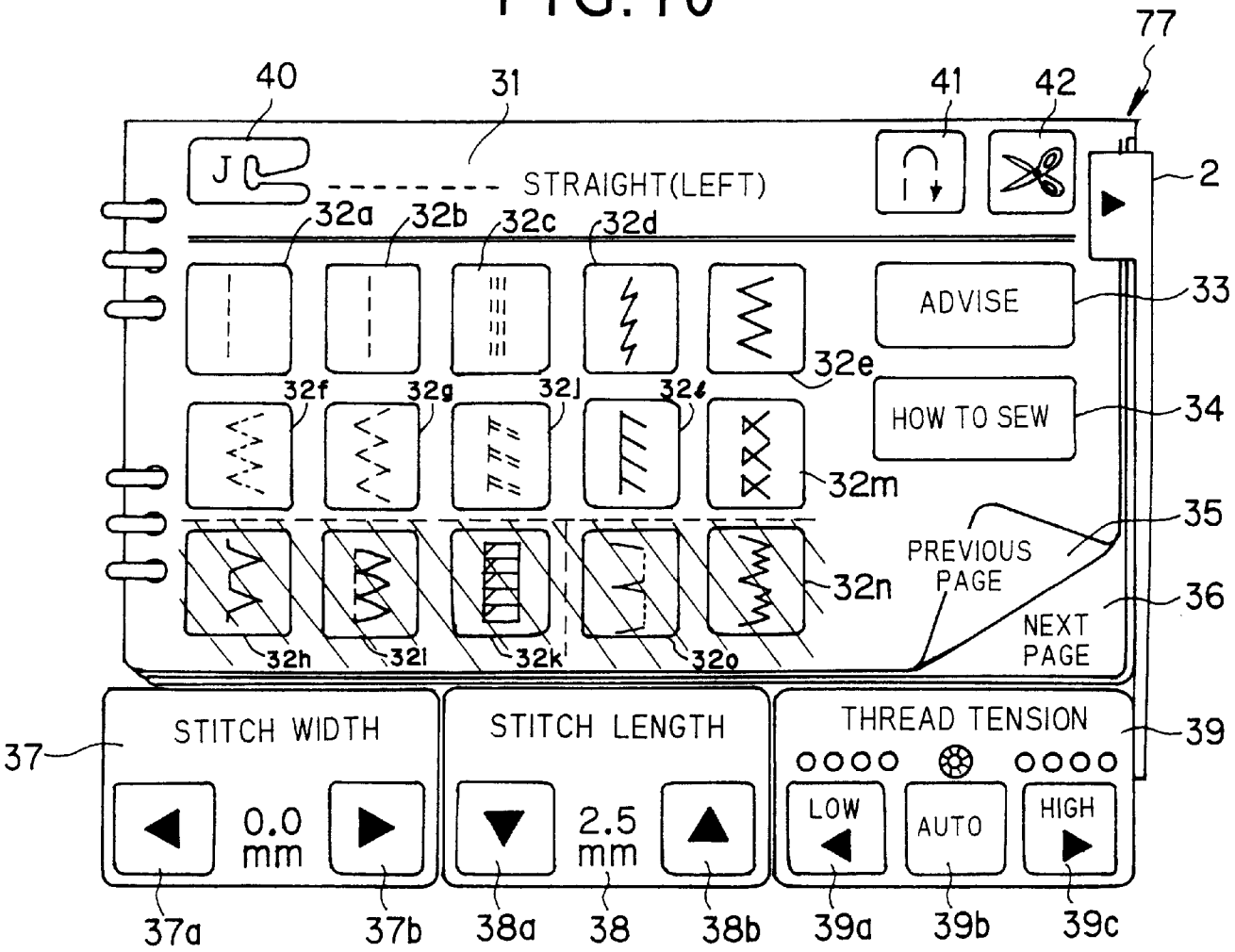
FIG. 10 is a plan view of another example of a picture plane for a selection in the embodiment.

Furthermore, for example, as shown in FIG. 10, a selection picture plane 78 may be displayed such that the keys corresponding to the patterns using the same presser foot are collectively displayed as one set, the border line of this one set is indicated by a dashed line, and that the keys corresponding to the sewing patterns different from the presently selected sewing pattern using the presser foot used in the sewing operation of the presently selected sewing pattern are displayed in a full tone while the keys corresponding to other sewing patterns not-using the presser foot used in the sewing operation of the presently selected sewing pattern are displayed in a half tone.

In this way, if the display color is changed and displayed on the basis of the presser foot to be used, it is possible to distinguish the sewing patterns using the same presser foot from the other sewing patterns using the different presser foot, to thereby improve the operability of the sewing apparatus.

Namely, since the keys indicating the patterns, which can be sewn in correspondence with the kind of the presser foot used in the sewing operation, are displayed in a distinguishable manner for each kind of the presser foot, it is possible to easily recognize the relationship between the pattern to be sewn and the presser foot to be used in correspondence with the pattern to be sewn, so that the preparation for the sewing operation can be easily executed.

Further, since a plurality of keys indicating the patterns corresponding to plural kinds of presser feet are displayed for each presser foot on a single picture plane of the LCD 2, even in case that there exist plural kinds of presser feet corresponding to a plurality of patterns, it is possible to easily recognize the relationship between the pattern to be sewn and the presser foot to be used in correspondence with the pattern to be sewn, so that the preparation for the sewing operation can be easily executed.

Furthermore, since the keys are displayed such that plural kinds of patterns which can be sewn can be selected, it is possible to sew the pattern by selecting the presser foot and the pattern corresponding to each other while easily correlating them.

Even in case that the LCD displays the symbol in white and black, since it is possible to display the keys corresponding to the kinds of the presser feet such that the keys can be distinguished from each other for each presser foot, the cost reduction can be promoted as compared with the case that the LCD 2 capable of color-displaying is employed.

Moreover, since a plurality of keys corresponding to the patterns to be sewn by using the same presser foot are collectively displayed on a single picture plane of the LCD 2, it is possible to easily recognize the patterns to be sewn by using the same presser foot.

Next, in addition to the example of the practical sewing patterns aforementioned with reference to FIG. 3A, some more actual examples of classifying the pattern selection keys on the basis of the kinds of the embroidery patterns and displaying each kind of the pattern using a different color are explained with reference to FIGS. 11 to 13.

Figure 11:
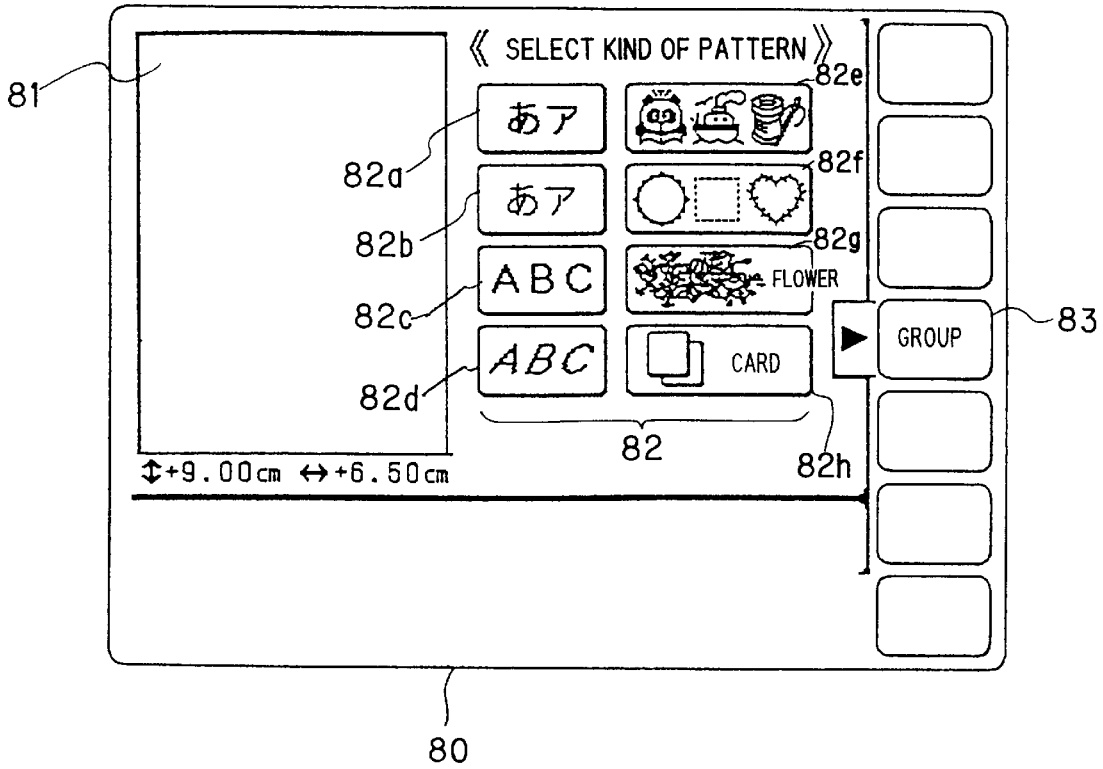
FIG. 11 is a plan view of another example of a picture plane for a selection in the embodiment.

As shown in FIG. 11, a selection picture plane 80 may be displayed. Namely, a selection pattern display region 81 in which the selected pattern is displayed. A plurality of pattern group selection keys 82 are displayed such that the region of a pattern group selection key 82*a* to select Japanese Characters "Hiragana" or "Katakana" represented by "あア" in a thick line is displayed by using dark blue color, the region of a pattern group selection key 82*b* to select Japanese Characters "Hiragana" or "Katakana" represented by "あア" in a thin or normal line is displayed by using light blue color, the region of a pattern group selection key 82*c* to select alphabets represented by "ABC" in a normal shape is displayed by using read color, the region of a pattern group selection key 82*d* to select alphabets represented by "ABC" in an inclined shape is displayed by using pink color, the region of a pattern group selection key 82*e* to select a one-point comic pattern (such as animals, vessels and vehicles) is displayed by using orange color, the region of a pattern group selection key 82*f* to select symbols set in advance is displayed by using yellow color, the region of a pattern group selection key 82*g* to select flowers is displayed by using green color, and the region of a pattern group selection key 82*h* to select embroidery patterns stored in memory cards set in advance is displayed by using white color. Further, a group key 83 is high-lighted to indicate that the pattern group selection keys 82 are presently being selected and displayed.

The case in which the pattern group selection key 82*e* is selected in FIG. 11 for example is explained with reference to FIG. 12.

Figure 12:
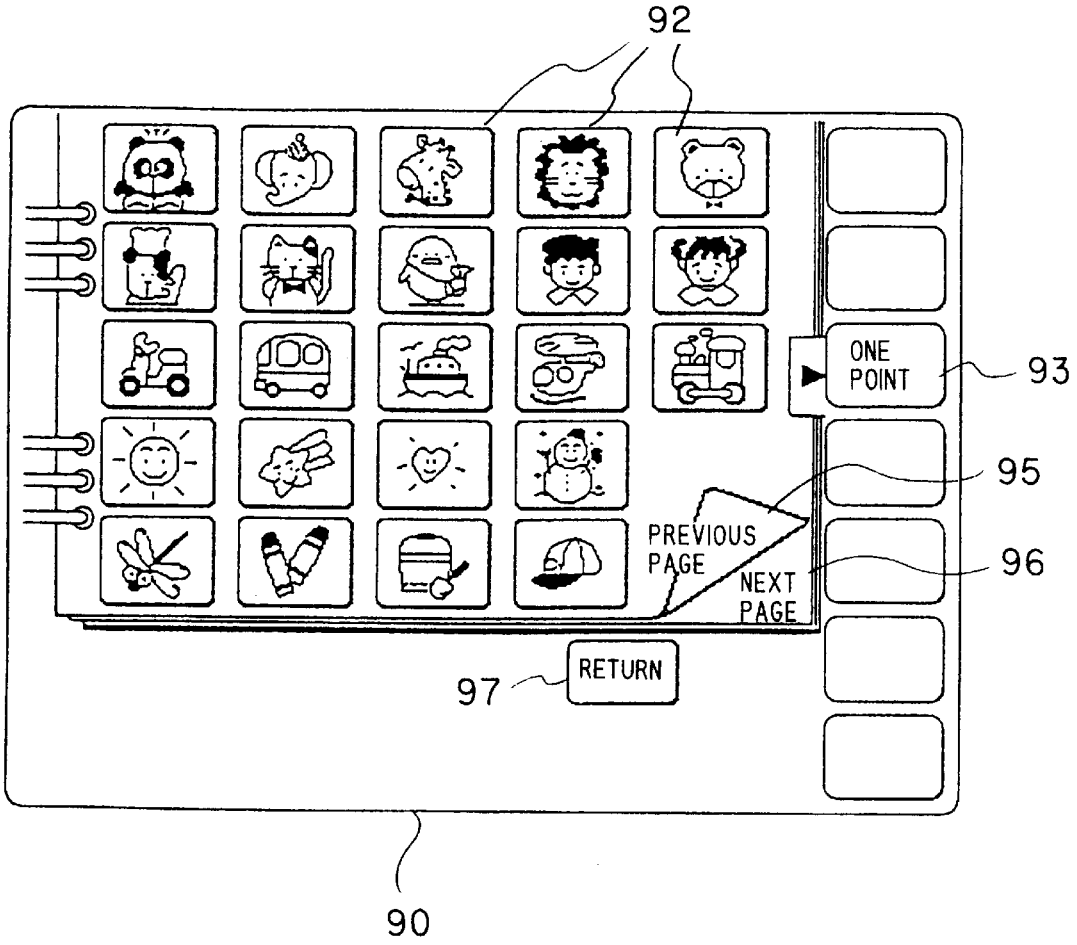
FIG. 12 is a plan view of another example of a picture plane for a selection in the embodiment.

As shown in FIG. 12 in this case, a selection picture plane 90 may be displayed such that a plurality of pattern selection keys 92 corresponding to the patterns in the selected pattern group are displayed as one set. Here, the color of the background of these pattern selection keys 92 is the orange color which corresponds to the color of the pattern group selection key 82*e* in the selection picture plane 80 in FIG. 11. Further, there are displayed: a previous page key 95 to display the previous page of the presently displayed page; a next page key 96 to display the next page of the presently displayed page; and a return key 97 to return to the selection picture plane 80 shown in FIG. 11. Each of these pattern selection keys 92 is displayed by using the color corresponding to the color of the thread to be actually used in the respective one of the patterns. In addition, a one-point key 93 is high-lighted to indicate that the pattern selection keys 92 are presently being selected and displayed.

The case in which the pattern group selection key 82*c* is selected in FIG. 11 for example, is explained with reference to FIG. 13.

Figure 13:
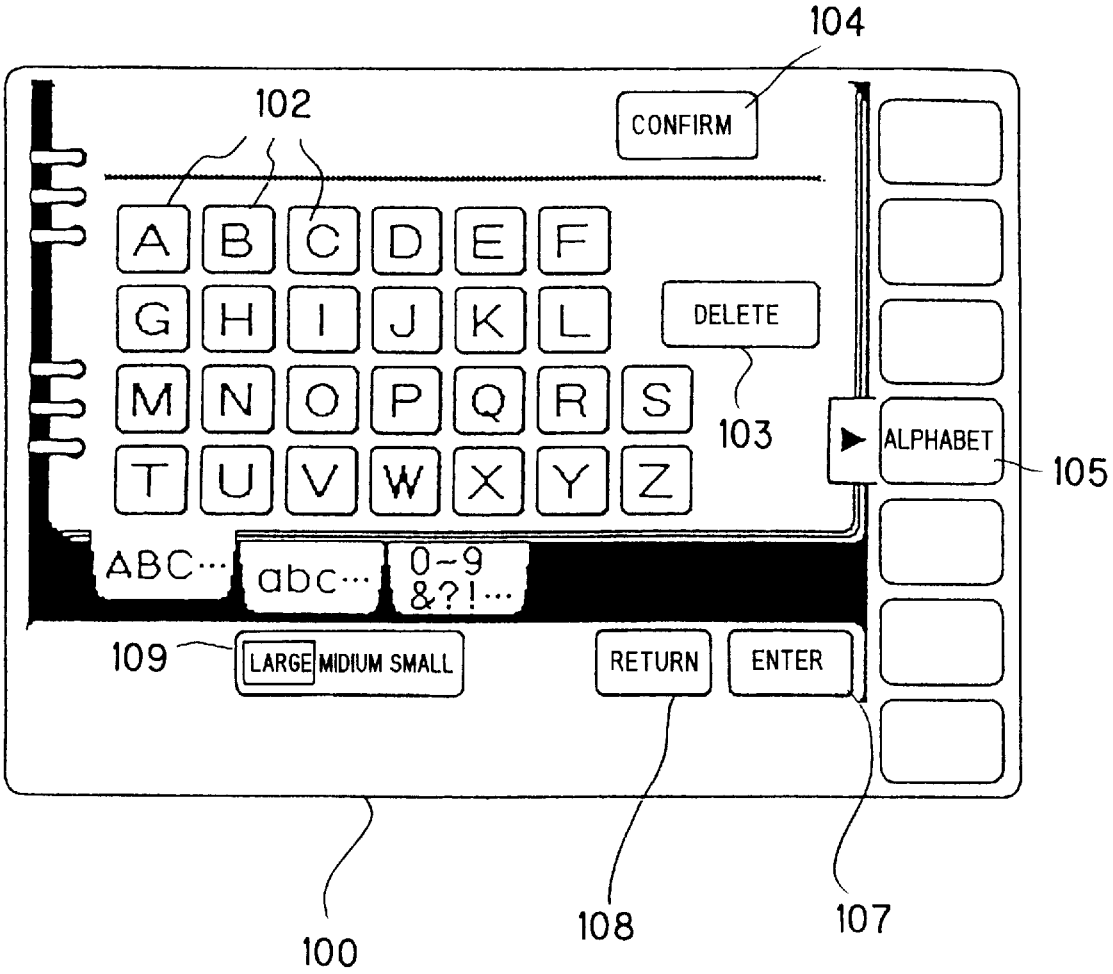
FIG. 13 is a plan view of another example of a picture plane for a selection in the embodiment.

As shown in FIG. 13 in this case, a selection picture plane 100 may be displayed such that a plurality of pattern selection keys 102 corresponding to the patterns in the selected pattern group are displayed as one set. Here, the color of the background of these pattern selection keys 102 is the red color which corresponds to the color of the pattern group selection key 82*c* in the selection picture plane 80 in FIG. 11. Further, there are displayed: a delete key 103 to delete a provisionally selected pattern; a confirm key 104 to confirm a provisionally selected pattern; an enter key to enter the selected pattern; a return key 108 to return to the selection picture plane 80 shown in FIG. 11; and a size key 109 to set the size of each selected pattern to large, medium or small. Each of these pattern selection keys 102 is displayed by using the black color on the background red color. In addition, an alphabet key 105 is high-lighted to indicate that the pattern selection keys 102 are presently being selected and displayed.

As explained above in each actual examples for the selection picture plane in the embodiment, since the keys are displayed by using the respective color for each group classified based on the kind of the sewing pattern, it is possible to easily identify the corresponding pattern group selection key 82 in response to the sewing pattern.

The case in which the touch panel 25 is a so-called digital type touch panel which includes a plurality of keys constituted by the transparent switches is explained in the embodiment. In addition, the present invention can be applied to even a case in which the touch panel 25 is a so-called analog type touch panel wherein the resistance variations resulting from the entirely pushed pressure are accumulated and thereby a position of the pushed pressure is detected from an infinite number of (unspecified) positions on the touch panel 25, by changing the colors displayed by the respective keys.

The relative movement between the cloth and the sewing needle 7 during sewing may be performed by either one of the embroidery device 70 and the feed dog mechanism, and may be performed by sewing the sewing needle 7 and the needle bar.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosures of Japanese Patent Application No.09-267425 filed on Sep. 30, 1997 and Japanese Patent Application No.09-284699 filed on Sep. 30, 1997 each including the specification, claims, drawings and summary are incorporated herein by reference in its entirety.

What is claimed is:

1. A sewing apparatus, comprising:

a stitch forming device;

a driving device for driving said stitch forming device;

a controller for controlling said driving device;

a displaying device including a plurality of display segments, each of which indicates information to control a sewing process through said controller on a surface of said displaying device, said display segments being divided into a plurality of segment groups, each of which includes at least one display segment, on the basis of a prcdetermined criterion; and a display controlling device for controlling said displaying device to display thereon all of the at least one segment belonging to one of the segment groups and all of the at least one segment belonging to another of the segment groups so as to be visually differentiated from each other, wherein said display controlling device controls said displaying device to display thereon all of the at least one segment belonging to one of the segment groups in one color and all of the at least one segment belonging to another of the segment groups in another color.

2. A sewing apparatus according to claim 1, wherein the display segments comprise a plurality of areas respectively into which one picture plane is divided, each of the areas corresponding to the information to control the sewing process.

3. A sewing apparatus according to claim 1, wherein said display controlling device controls said displaying device to display the at least one segment belonging to one of the segment groups and the at least one segment belonging to another of the segment groups with a boundary line therebetween.

4. A sewing apparatus according to claim 1, wherein said displaying device comprises a switch panel, said display segments comprise switches respectively on the surface of said switch panel, for selecting one of sewing patterns to be sewn in the sewing process, and said switches are divided into a plurality of switch groups as the segment groups on the basis of the predetermined criterion.

5. A sewing apparatus according to claim 1, further comprising:

at least one sewing machine including said stitch forming device and said driving device; and a controlling unit externally connected to said at least one sewing machine and including said controller, said displaying device and said display controlling device.

6. A sewing apparatus according to claim 1, wherein said display controlling device controls said displaying device to display symbols indicating sewing patterns on the display segments respectively in a differentiated manner for each of the segment groups.

7. A sewing apparatus, comprising:

a stitch forming device;

a driving device for driving said stitch forming device;

a controller for controlling said driving device;

a displaying device including a plurality of display segments each of which indicates information to control a sewing process through said controller, on a surface of said displaying device, said display segments being divided into a plurality of segment groups, each of which includes at least one display segment, on the basis of a predetermined criterion; and a display controlling device for controlling said displaying device to display thereon all of the at least one segment belonging to one of the segment groups and all of the at least one segment belonging to another of the segment groups so as to be visually differentiated from each other, wherein said display controlling device controls said displaying device to display thereon all of the at least one segment belonging to one of the segment groups in one tone and all of the at least one segment belonging to another of the segment groups in another tone.

8. A sewing apparatus, comprising:

a stitch forming device;

a driving device for driving said stitch forming device;

a controller for controlling said driving device;

a displaying device including a plurality of display segments, each of which indicates information to control a sewing process through said controller, on a surface of said displaying device, said display segments being divided into a plurality of segment groups, each of which includes at least one display segment, on the basis of a predetermined criterion; and a display controlling device for controlling said displaying device to display thereon all of the at least one segment belonging to one of the segment groups and all of the at least one segment belonging to another of the segment groups so as to be visually differentiated from each other, wherein said displaying device comprises a color switch panel, said display segments comprise transparent switches respectively on the surface of said switch panel, for selecting one of sewing patterns to be sewn in the sewing process, the transparent switches are divided into a plurality of switch groups as the segment groups on the basis of kinds of the sewing patterns corresponding to the transparent switches respectively, each of the switch groups including at least one transparent switch and said display controlling device comprises a color display controlling device for controlling said displaying device to perform a color display on said color switch panel by using one color for all of the at least one transparent switch belonging to one of the switch groups and by using another color for all of the at least one transparent switch belonging to another of the switch groups.

9. A sewing apparatus according to claim 8, wherein the at least one transparent switch corresponding to a same kind of the sewing pattern constitutes a same switch group.

10. A sewing apparatus according to claim 8, wherein the at least one transparent switch corresponding to straight stitching constitutes one switch group, the at least one transparent switch corresponding to zigzag stitching constitutes another switch group, the at least one transparent switch corresponding to over casting constitutes another switch group, and the at least one transparent switch corresponding to blind stitching constitutes another switch group.

11. A sewing apparatus according to claim 8, wherein the at least one transparent switch corresponding to the sewing pattern sewn by using a predetermined presser foot constitutes a switch group.

12. A sewing apparatus, comprising:

a stitch forming device;

a driving device for driving said stitch forming device;

a controller for controlling said driving device;

a displaying device including a plurality of display segments, each of which indicates information to control a sewing process through said controller, on a surface of said displaying device, said display segments being divided into a plurality of segment groups, each of which includes at least one display segment, on the basis of a predetermined criterion; and a display controlling device for controlling said displaying device to display thereon all of the at least one segment belonging to one of the segment groups and all of the at least one segment belonging to another of the segment groups so as to be visually differentiated from each other, wherein said display controlling device controls said displaying device to display symbols indicating sewing patterns on the display segments respectively in a differentiated manner for each of the segment groups, said display segments are divided into the segment groups on the basis of kinds of presser feet, each of which is used for the sewing process, and said display controlling device controls said displaying device to display the symbols indicating sewing patterns sewn in correspondence with the kinds of the presser feet.

13. A sewing apparatus according to claim 12, wherein the sewing patterns comprise practical sewing patterns.

14. A sewing apparatus according to claim 12, wherein the sewing patterns comprise embroidery patterns.

15. A sewing apparatus according to claim 12, wherein said display controlling device controls said displaying device to display the symbols indicating the sewing patterns on a single picture plane on said displaying device.

16. A sewing apparatus according to claim 12, wherein said displaying device comprises a switch panel, said display segments comprise switches respectively on the surface of said switch panel, for selecting one of the sewing patterns to be sewn in the sewing process while displaying the symbols on the switches respectively, and said switches are divided into a plurality of switch groups as the segment groups on the basis of the predetermined criterion.

17. A sewing apparatus according to claim 12, wherein said displaying device displays the symbols in monochrome.

18. A sewing apparatus according to claim 12, wherein said displaying device displays the symbols in full color.

19. A sewing apparatus according to claim 12, further comprising a selecting device for selecting one of the sewing patterns to be sewn in the sewing process by selecting one of the symbols displayed on the display segments respectively, said display controlling device controlling said displaying device to display (i) the symbols indicating the sewing patterns in one of the segment groups and (ii) the symbols indicating the sewing patterns in another of the segment groups, in the differentiated manner from each other.

20. A sewing apparatus according to claim 14, wherein said display controlling device controls said displaying device to collectively display the symbols, which correspond to the sewing patterns in a respective one of the segment groups, on a single picture plane on said display device.

21. A sewing apparatus comprising:

a stitch forming means;

a driving means for driving said stitch forming means;

a control means for controlling said driving means;

a displaying means including a plurality of display segments, each of which indicates information to control a sewing process through said control means, on a surface of said displaying means, said display segments being divided into a plurality of segment groups, each of which includes at least one display segment, on the basis of a predetermined criterion; and a display controlling means for controlling said displaying means to display thereon all of the at least one segment belonging to one of the segment groups and all of the at least one segment belonging to another of the segment groups so as to be visually differentiated from each other, wherein said display controlling means controls said displaying means to display thereon all of the at least one segment belonging to one of the segment groups in one color and all of the at least one segment belonging to another of the segment groups in another color.

* * * * *